US005658832A

United States Patent [19]

Bernhardt et al.

[11] Patent Number: 5,658,832

[45] Date of Patent: Aug. 19, 1997

[54] METHOD OF FORMING A SPACER FOR FIELD EMISSION FLAT PANEL DISPLAYS

[75] Inventors: Anthony F. Bernhardt, Berkeley; Robert J. Contolini, Pleasanton, both of Calif.

[73] Assignee: Regents of the University of California, Oakland, Calif.

[21] Appl. No.: 324,052

[22] Filed: Oct. 17, 1994

[51] Int. Cl.[6] ..... H01J 9/00

[52] U.S. Cl. ..... 264/272.11; 437/228; 437/235; 427/77; 427/105; 427/106; 427/133; 264/61; 445/24

[58] Field of Search ..... 445/24; 437/228, 437/225, 235; 156/643.1, 656.1, 662.1, 657.1; 216/39, 40, 64, 67; 427/77, 105, 106, 108, 126.2, 126.4, 133; 264/61

[56] References Cited

U.S. PATENT DOCUMENTS

| | | | |
|---|---|---|---|
| 4,806,290 | 2/1989 | Hopper et al. | 264/28 |
| 4,873,218 | 10/1989 | Pekala | 502/418 |
| 4,923,421 | 5/1990 | Brudie et al. | 445/24 |
| 4,997,804 | 3/1991 | Pekala | 502/418 |
| 5,098,910 | 3/1992 | Becker et al. | 514/299 |
| 5,116,876 | 5/1992 | Davidson et al. | 522/1 |
| 5,205,770 | 4/1993 | Lowrey et al. | 445/24 |
| 5,232,549 | 8/1993 | Cathey et al. | 445/24 |
| 5,260,855 | 11/1993 | Kaschmitter et al. | 361/502 |
| 5,395,805 | 3/1995 | Droege et al. | 501/72 |
| 5,409,683 | 4/1995 | Tillotson et al. | 423/338 |
| 5,424,605 | 6/1995 | Lovoi | 313/422 |
| 5,461,003 | 10/1995 | Havemann et al. | 437/228 |
| 5,470,802 | 11/1995 | Gnade et al. | 437/238 |
| 5,488,015 | 1/1996 | Havemann et al. | 437/238 |
| 5,492,234 | 2/1996 | Fox, III | 216/25 |
| 5,494,858 | 2/1996 | Gnade et al. | 437/238 |
| 5,503,582 | 4/1996 | Cathey, Jr. et al. | 445/24 |
| 5,504,042 | 4/1996 | Cho et al. | 437/238 |
| 5,509,840 | 4/1996 | Huang et al. | 445/24 |

OTHER PUBLICATIONS

Worf, Stanley. "Silicon Processing for The VLSI Era", vol 1, pp. 547–555 and 564–565.

UCRL–99846, "Resorcinol–Formaldehyde Aerogels And Their Carbonized Derivatives", R.W. Pekala et al., Oct. 24, 1988.

*Primary Examiner*—Charles L. Bowers, Jr.
*Assistant Examiner*—Matthew Whipple
*Attorney, Agent, or Firm*—L. E. Carnahan; Henry P. Sartorio

[57] ABSTRACT

Spacers for applications such as field emission flat panel displays and vacuum microelectronics, and which involves the application of aerogel/xerogel technology to the formation of the spacer. In a preferred approach the method uses a mold and mold release agent wherein the gel precursor is a liquid which can be applied to the mold filling holes which expose the substrate (either the baseplate or the faceplate). A release agent is applied to the mold prior to precursor application to ease removal of the mold after formation of the dielectric spacer. The shrinkage of the gel during solvent extraction also improves mold removal. The final spacer material is a good dielectric, such as silica, secured to the substrate.

10 Claims, 1 Drawing Sheet

METHOD OF FORMING A SPACER FOR FIELD EMISSION FLAT PANEL DISPLAYS

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to standoffs for field emission flat panel displays, for example, particularly to dielectric spacers to separate the phosphor faceplate from the field emitter cathode or baseplate, and more particularly to a method of fabricating such dielectric spacers utilizing aerogel/xerogel technology.

One of the problems in field emission technologies, such as in the production of field emission flat plate displays and in vacuum microelectronics, for example, is the need for an effective spacer to separate the phosphor faceplate from the field emitter cathode or baseplate. Such a spacer must withstand atmospheric pressure which tends to collapse the space between the faceplate and baseplate and it must provide standoff against high voltage which is imposed between the two plates. In addition, the spacer must be inexpensive to fabricate.

Various types of prior spacers have been developed. One such prior approach involves making the spacers from a sheet of polymer using anisotrupic etching in an oxygen plasma. While satisfactory spacers had been produced using this approach, the etching rate (~3 μm/min) was too slow to be economically viable. Thus, there exists a need for such spacers which can withstand both the atmospheric pressure and high voltage conditions, but can be fabricated economically. Such a need is satisfied by the present invention which in a preferred approach involves an application of the aerogel/xerogel technology to the formation of the spacer using a mold and mold release agent. The final spacer material is a good dielectric, such as silica.

SUMMARY OF THE INVENTION

It is an object of the present invention to provide a method for forming dielectric spacers.

A further object of the invention is to provide a spacer to separate the phosphor faceplate from the field emitter cathode in field emission devices.

A further object of the invention is to provide a method for economically fabricating a spacer which can withstand atmosphere pressure conditions and provide a standoff against high voltage.

Another object of the invention is to provide a dielectric spacer fabrication process which utilizes the aerogel/xerogel technology using a mold and mold release agent.

Another object of the invention is to provide an inexpensive method for producing dielectric spacers for use in field emission technologies.

Other objects and advantages of the present invention will become apparent from the following description and accompanying drawings. The invention is a method for fabricating spacers used between the faceplate and baseplate of a field emission flat panel display, for example, and which are capable of withstanding the pressure and high voltage conditions imposed thereon, while being economically viable. The invention involves the application of aerogel/xerogel technology to the formation of the spacers and in a preferred approach uses a mold and mold release agent, with the final spacer material being a good dielectric, such as silica. The gel precursor is a liquid which can be applied to the mold fitting holes or slots which expose the substrate (either the baseplate or the faceplate). A release agent is applied to the mold prior to precursor application to ease removal of the mold after formation of the dielectric spacer by techniques well-known in the art. The shrinkage of the gel during solvent extraction also improves mold removal. The spacers produced by the method of this invention have the capability to withstand atmospheric pressure which tends to collapse the space between the phosphor faceplate and the field emitter cathode or baseplate, provide standoff against high voltage imposed between the two plates, and are inexpensive to fabricate. The invention has application in various field emission technologies, particularly in the production of field emission flat panel displays and in vacuum microelectronics.

BRIEF DESCRIPTION OF THE DRAWINGS

The accompanying drawings, which are incorporated into and form a part of the disclosure, illustrate a method of the invention and, together with the description, serve to explain the principles of the invention.

DETAILED DESCRIPTION OF THE INVENTION

Figure 1:
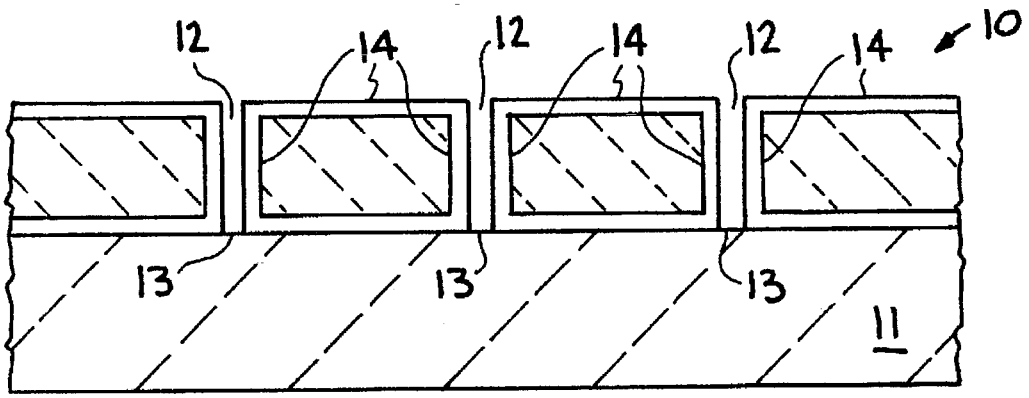
FIG. 1 is an enlarged cross-sectional view of a mold positioned on a substrate and having a release agent on the surfaces of the mold, in accordance with a preferred fabrication method of the invention.

The invention is a method for fabricating a spacer to separate the phosphor faceplate from the field emitter cathode or baseplate of field emission flat panel displays, for example. The spacer as formed by this invention can withstand atmospheric pressure and thus prevent collapse of the space between the two plates, and it provides standoff against high voltage which is imposed between the two plates. Furthermore, the spacer formed by this invention is inexpensive to fabricate.

Basically, the preferred method of the invention is to apply the aerogel/xerogel technology to the formation of the spacer using template or mold and mold release agent, and fill it with silica or other gel precursor, and then do solvent extraction to make what is known as an xerogel or aerogel (depending on the extraction procedure), which causes shrinkage. The final spacer material is a good dielectric, such as silica, alumina, or titania. The gel precursor is a liquid which can be applied to the mold filling holes which expose the substrate (either the baseplate or the faceplate). A release agent is applied to the mold prior to gel precursor application to ease removal of the mold after formation of the dielectric spacer by techniques well-known in the art. The shrinkage of the gel during solvent extraction also improves mold removal, leaving the spacer(s) secured to the substrate.

Another approach, according to the present invention, to forming the spacers involves using a sheet of aerogel polymer (or aerogel foam), the aerogel density being a fraction of the bulk polymer material, as utilized in the above-referenced prior technique, and using anisotropic etching in an oxygen plasma. The etch rate would be many times faster than that of the bulk polymer material referenced above, and as long as the aerogel (or aerogel foam) cell size was much less than the width of the spacer, the oxygen etch would produce the desired anisotropy (using a metal or other inert mask or template).

By way of example, in the aerogel polymer/anisotropic etching approach, the aerogel polymer may have a density of 2.5 to 1,250 mg/cc, and a cell size of 20 to 500 angstroms. The anisotropic etching rate is 10,000 to 100,000 Å/min. and carried out by etching in a $SF_6$ or $CHF_3$ or $CF_4$ gaseous plasma with or without oxygen at room temperature with powers of 1–25 watts/$cm^2$ for a duration of 10–100 minutes.

The aerogel/xerogel technology is well known, and various processes have been developed for producing aerogel and/or xerogel foams, and hybrids thereof. The formation of an xerogel or an aerogel is dependent of the solvent extraction and drying procedures utilized, with the xerogels using solvent extraction below the liquid/gas critical point resulting in material of 50–100% of bulk density, where aerogels are solvent extracted above the critical point resulting in materials of 0.1–50% of bulk density. Various processes for producing different types of gels including sol-gels, silica gels, aerogels, xerogels, etc. for the formation of different materials are described in U.S. Pat. No. 4,873,218 issued Oct. 10, 1989 to R. W. Pekala. Processes for fabricating different aerogels and xerogels are also described in UCRL-99846 entitled "Resorcinol-Formaldehyde Aerogels and Their Carbonized Derivatives", R. N. Pekala et al., dated Oct. 24, 1988, and in U.S. Pat. No. 4,806,290 issued Feb. 21, 1989 to R. W. Hopper et al.; U.S. Pat. No. 4,997,804 issued Mar. 5, 1991 to R. W. Pekala; and U.S. Pat. No. 5,260,855 issued Nov. 9, 1993 to J. L. Kaschmitter et al.

Figure 2:
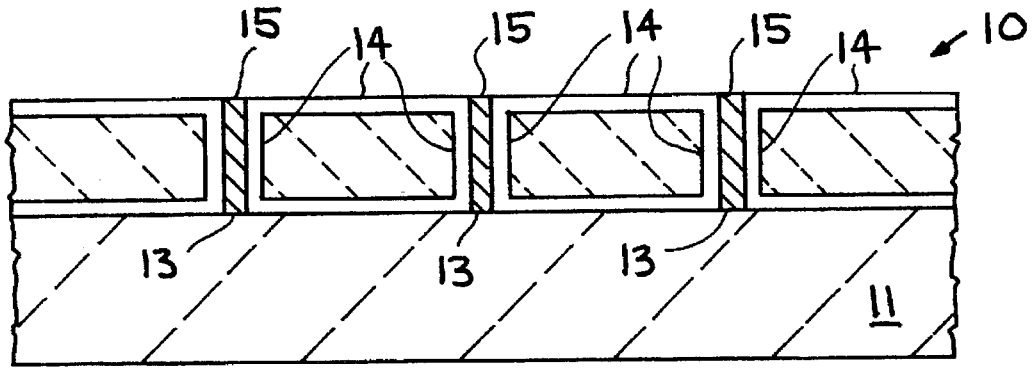
FIG. 2 is a view similar to FIG. 1 with the holes or spaces in the mold filled with an aerogel/xerogel gel precursor in accordance with the invention.
Figure 3:
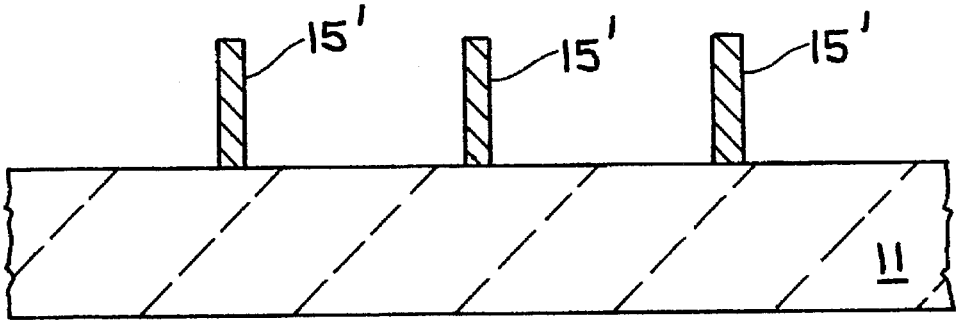
FIG. 3 is an enlarged cross-sectional view of a plurality of dielectric spacers secured to the substrate of FIG. 2 following removal of the mold in accordance with the invention.

The preferred process of the invention is carried out as described thereinafter and as illustrated in FIGS. 1–3. As shown in FIG. 1, a template or mold, generally indicated at 10, is positioned on a substrate (faceplate or baseplate, for example) 11, with mold 10 having a plurality of openings or holes 12, having a width of 20 to 100 μm and height of 200 to 1000 μm, by which areas 13 of the upper surface of the substrate 11 are exposed. The upper surface of mold 10 and the sides of the openings 12 therein are covered with a release agent, indicated by the thin film 14. The openings or holes 12 are then filled with a liquid gel precursor described in detail hereinafter, as indicated at 15 in FIG. 2. The gel precursor 15 is then submitted to appropriate solvent extraction and drying procedures, as exemplified hereinafter. Whereafter, the mold 10 is removed leaving aerogel/xerogel spacers 15' secured to the substrate 11 as seen in FIG. 3, and having, for example, silica of a density of 0.1 to 1.0 g/$cm^3$ and cell size of 100 to 500 Å. Due to the release agent 14, which is composed of glycerol, silicone, or wax and the shrinkage of the aerogel/xerogel material during the solvent extraction and drying procedures, the mold 10 is easily removed from around the spacers without adversely effecting the adhesion between the spacers and the substrate.

The liquid gel precursor 15 used to fill the openings 12 in mold 10 and containing a dielectric, and which has good adhesion to the substrate 11 may be composed of tetramethoxy or tetraethoxy silane with methanol or ethanol or glycerin or acetonitrile.

By way of example, a silica gel precursor may be formed by room temperature gels formed within a few minutes by additions of 0.0001% to 1% (by weight) of a strong base such as $NH_4OH$ or a strong acid, such as HCl to the gel precursor materials.

The solvent extraction and drying process to form an xerogel material from the above-exemplified gel precursor composed of methanol, tetramethoxy silane, and $NH_4OH$ is carried out by heating the gel in an oven with air or nitrogen from 100° C. to 150° C. for 1 to 24 hours.

The solvent extraction and drying process to form an aerogel material from the above-exemplified gel precursor is carried out by heating the gel in a methanol filled container to 255° C., pressurizing to 10,000 psi, and then slowly (over 5 to 24 hrs.) lowering the pressure and temperature to one atmosphere and room temperature, and pumping out all the methanol.

It has thus been shown that the present invention enables the formation of spacers for field emission technologies, for example, which can withstand the pressure and high voltage conditions, and be economically fabricated, using existing aerogel/xerogel technology in combination with a template or mold and a mold release agent. Dielectric spacers made by the above-described techniques advance the state-of-the-art, and are particularly useful in the production of field emission flat panel displays and in vacuum microelectronics.

While a particular apparatus, operational sequence, gel precursors, solvent extraction and drying techniques, etc. have been illustrated and/or described to illustrate and exemplify the method for producing the dielectric spacers, such are not intended to be limiting. Modifications and changes will become apparent to those skilled in the art, and it is intended that the invention be limited only by the scope of the appended claims.

We claim:

1. A method of forming on a substrate a dielectric spacer capable of withstanding pressure and voltage conditions imposed in field emission applications, comprising:

providing a substrate; and forming at least one dielectric spacer directly on the substrate from material selected from the group consisting of dielectric containing aerogels and xerogels, wherein the spacer is formed by positioning a mold on a substrate, the mold having openings therein to expose at least one area of the substrate, applying a release agent to the mold, filling the mold with a liquid gel precursor, extracting solvent from the gel precursor, drying the gel precursor following solvent extraction, and removing the mold, thereby forming a spacer secured to the substrate;

wherein said release agent is selected from the group consisting of glycerol, silicone, and wax.

2. The method of claim 1, wherein the substrate is constructed to constitute a faceplate or a baseplate of a field emission device.

3. The method of claim 1, wherein the liquid gel precursor is formed to include a dielectric selected from the group consisting of silica, alumina and titania.

4. The method of claim 1, additionally including forming the liquid gel precursor from tetramethoxy or tetraethoxy silane with methanol or ethanol or glycerin or acetonitrile.

5. The method of claim 1, wherein the solvent extraction and drying process is carried out by heating the gel in an oven with air or nitrogen from 100° C. to 150° C. for 1–24 hours.

6. The method of claim 1, wherein the solvent extraction and drying is carried out by heating the gel in a methanol filled container to 255° C., pressurizing to 10,000 psi, and then lowering the pressure and temperature to 1 atmosphere and room temperature, and pumping out the methanol.

7. A method of forming at least one dielectric spacer secured to one of a phosphor faceplate and a field emitter cathode (baseplate) of a field emission flat panel display, comprising:

forming a mold on a surface of a substrate constituting one of the faceplate or baseplate;

providing the mold with at least one hole of a spacer configuration such that an area of the surface of the substrate is exposed through the hole;

providing a release agent on at least the surfaces of the mold forming the hole, wherein said release agent is selected from the group consisting of glycerol, silicone, and wax;

filling the hole of the mold with a liquid gel precursor containing a dielectric, carrying out solvent extraction and drying of the gel precursor; and removing the mold from the substrate, thereby forming at least one dielectric spacer directly secured to a surface of the substrate.

8. The method of claim 7, wherein the liquid gel precursor contains a dielectric selected from the group consisting of silica, alumina and titania.

9. The method of claim 8, wherein the liquid gel precursor is selected from the group consisting of tetramethoxy or tetraethoxy silane with methanol or ethanol or glycerin or acetonitrile.

10. The method of claim 9, wherein the thus produced dielectric spacer has a density of 2.5 to 1,250 mg/cc, and a cell size of 20 to 500 angstroms.

* * * * *